US006690809B2

(12) United States Patent
Miyamoto et al.

(10) Patent No.: US 6,690,809 B2
(45) Date of Patent: Feb. 10, 2004

(54) MICROSPEAKER

(75) Inventors: Kazumi Miyamoto, Yamanashi-ken (JP); Yoshizumi Ohta, Yamanashi-ken (JP); Takashi Kobayashi, Yamanashi-ken (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 47 days.

(21) Appl. No.: 09/977,347

(22) Filed: Oct. 16, 2001

(65) Prior Publication Data

US 2002/0054688 A1 May 9, 2002

(30) Foreign Application Priority Data

Nov. 6, 2000 (JP) ..... 2000-338397

(51) Int. Cl.[7] ..... H04R 25/00

(52) U.S. Cl. ..... 381/409; 381/396; 381/189; 381/394; 381/412; 340/391.1

(58) Field of Search ..... 381/355, 356, 381/357, 359, 360, 361, 177, 369, 409, 396, 410, 412, 398, 400, 391, 394, 393, 189, 181; 340/384.1, 391.1

(56) References Cited

U.S. PATENT DOCUMENTS 4,315,112 A * 2/1982 Hofer
4,376,233 A * 3/1983 Kamon
6,400,825 B1 * 6/2002 Miyamoto

* cited by examiner

*Primary Examiner*—Curtis Kuntz
*Assistant Examiner*—Dionne N. Harvey
(74) *Attorney, Agent, or Firm*—Dennison, Schultz, Dougherty & MacDonald

(57) ABSTRACT

A case comprises an upper case and a lower case. A vibrating plate is secured to the upper case, a voice coil is secured to an underside of the vibrating plate. Each end portion of the voice coil is engaged in a groove formed in the upper case.

2 Claims, 3 Drawing Sheets

MICROSPEAKER

BACKGROUND OF THE INVENTION

The present invention relates to a microspeaker used in a portable communication equipment such as a portable telephone and other equipments.

Referring to FIGS. 4 and 5 showing a conventional microspeaker, a yoke 2 made of magnetic material is embedded in a case 1 made of plastic by insert molding. A permanent magnet 3 is secured to the yoke 2, and a top plate 4 made of magnetic material is adhered to the magnet 3 to form a magnetic circuit and to form a magnetic gap between the top plate 4 and the yoke 2.

A vibrating plate 6 is secured to the case 1 at the periphery thereof. A voice coil 5 secured to the underside of the vibrating plate 6 is inserted in the magnetic gap. A protector 7 made of metal is secured to the case 1, interposing the vibrating plate 6. A plurality of sound discharge holes are formed in the case 1 and the protector 7.

A pair of ends 9 of the voice coil 5 are adhered to the underside of the vibrating plate 6 as shown in FIG. 4. Each of the ends 9 is outwardly extended from the case 1 passing through a groove formed in a peripheral wall of the case. On the underside of the case 1, a substrate 8 made of plastic is adhered, and a pair of terminal plates 10 are secured to the substrate 8. Each of the terminal plate has a V-shape and each end 9 is connected to one of the branches of the terminal plate 10 by solder 11. The other branch of the terminal plate 10 is used for connecting the end 9 to a circuit of the equipment to be mounted therein.

Thus, when a signal current is applied to the voice coil 5 through the terminal plates 10, the vibrating plate 6 vibrates to produce sounds.

In the conventional speaker, the voice coil 5 must be secured to the vibrating plate 6 before the vibrating plate is fixed to the case 1. However, since the vibrating plate 6 is made of a thin plastic film which is poor in stiffness, it is difficult to manipulate the vibrating plate, and to automatize the voice coil securing manufacturing process.

Furthermore, since the ends 9 of the voice coil are inserted between the case 1 and the protector 7, the vibrating plate 6 is slightly floated, which renders the adhesion of the vibrating plate irregular. In addition, the end 9 is stressed by the pressure for the adhesion of the vibrating plate.

SUMMARY OF THE INVENTION

An object of the present invention is to provide a microspeaker which may obviate the above described troubles.

According to the present invention, there is provided a microspeaker comprising a case comprised of an upper case and a lower case, a yoke made of magnetic material, a permanent magnet provided in the lower case, a vibrating plate secured to the upper case, a voice coil secured to an underside of the vibrating plate, and a protector plate secured to the upper case.

Each end portion of the voice coil is engaged in a groove formed in the upper case.

End portions of the voice coil are adhered to the underside of the vibrating plate.

These and other objects and features of the present invention will become more apparent from the following detailed description with reference to the accompanying drawings.

DETAILED DESCRIPTION OF THE PREFERRED EMBODIMENT

Figure 1:
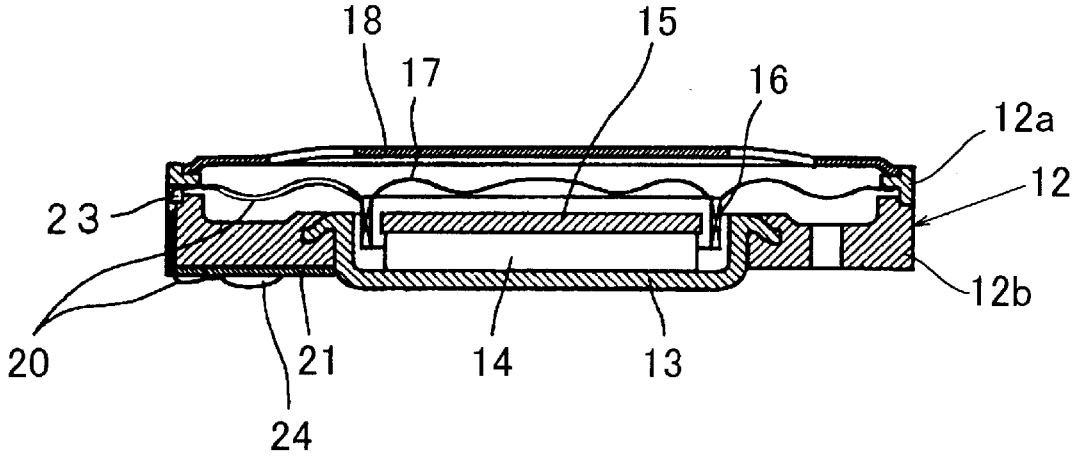
FIG. 1 is a sectional view of a microspeaker of the present invention.
Figure 2:
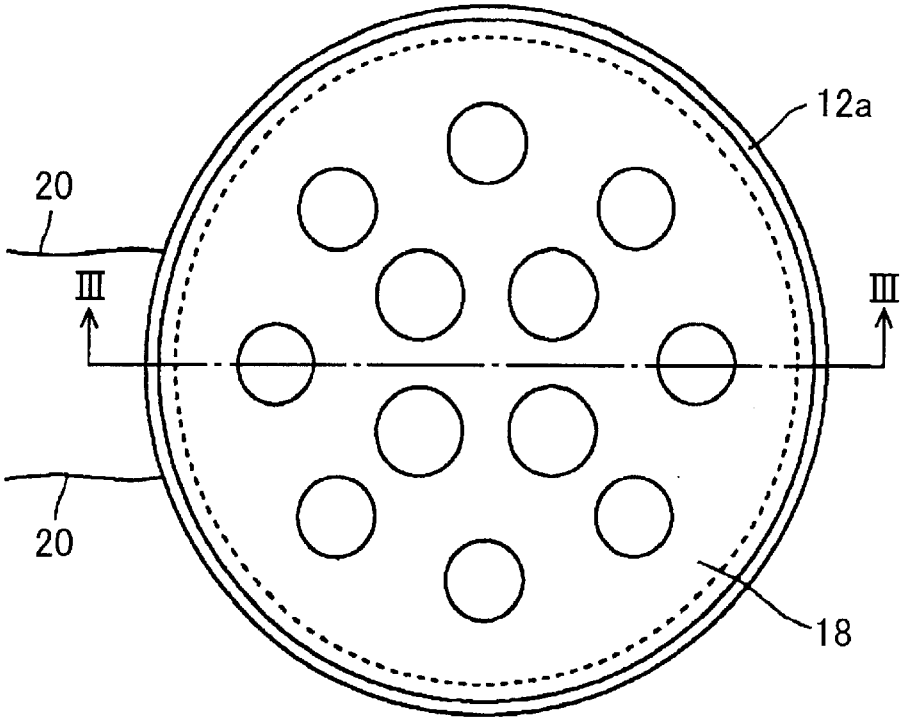
FIG. 2 is a plan view of the microspeaker of FIG. 1.

Referring to FIGS. 1 and 2, a case 12 made of plastic is divided into an upper case 12*a* and a lower case 12*b*, and both the cases 12*a* and 12*b* are adhered to each other by an adhesive. The microspeaker of the present invention comprises a yoke 13 made of magnetic material and embedded in the lower case 12*b* by insert molding, a permanent magnet 14 secured to the yoke 13, and a top plate 15 adhered to the magnet 14.

A vibrating plate 17 is secured to the underside of the upper case 12*a* at the periphery thereof. A voice coil 16 secured to the underside of the vibrating plate 17 is inserted in the magnetic gap between the top plate 15 and the yoke 13. A protector plate 18 made of metal is secured to the upper case 12*a*. A plurality of sound discharge holes are formed in the lower case 12*b* and the protector plate 18.

Figure 5:
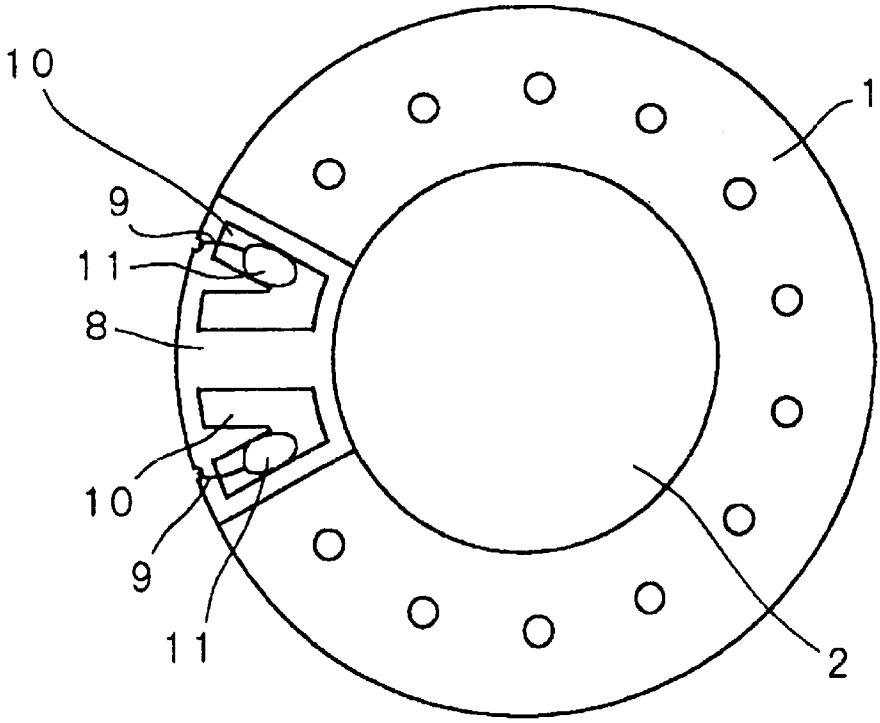
FIG. 5 PRIOR ART
FIG. 5 shows an underside of the microspeaker of FIG. 4.

A pair of ends 20 of the voice coil 16 are adhered to the underside of the vibrating plate 17. Each of the ends 20 is outwardly extended from the upper case 12*a* passing through a groove 23 formed in a peripheral wall of the upper case, and bent along the peripheral wall of the lower case 12*b* and fixed to a terminal plate on a substrate 21 by solder 24. The terminal plate has the same shape as the conventional terminal plate 10 of FIG. 5. The terminal plate is contacted with a terminal of an equipment in which the microspeaker is mounted.

Figure 3:
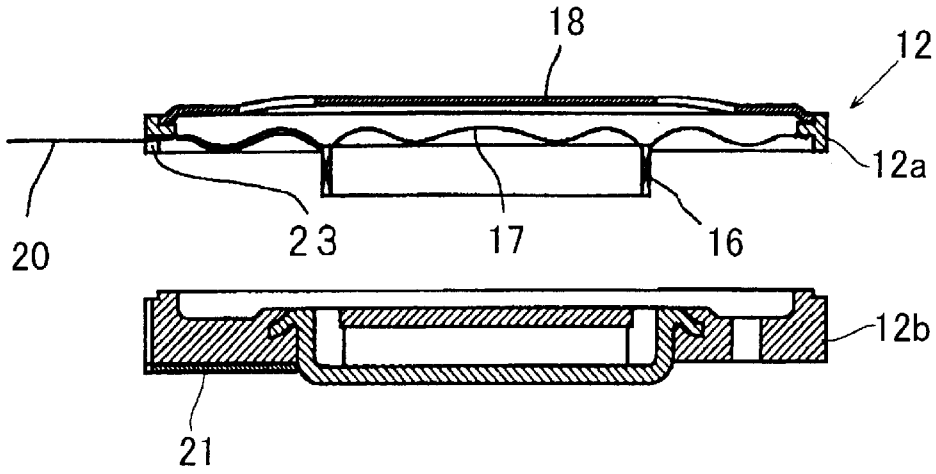
FIG. 3 is a sectional view taken along a line III—III of FIG. 2.

FIGS. 2 and 3 show conditions of the case 12 before assembling.

Figure 4:
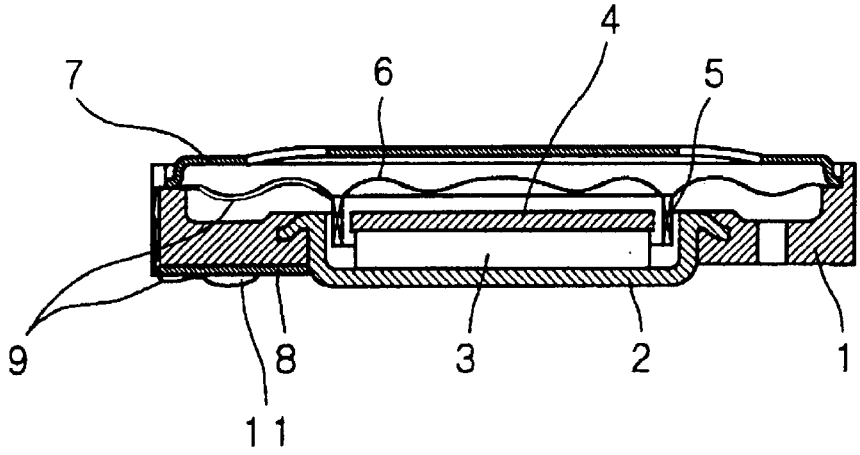
FIG. 4 PRIOR ART
FIG. 4 is a sectional view of a conventional microspeaker.

In the conventional speaker of FIG. 4, the voice coil 5 must be secured to the vibrating plate 6 before the vibrating plate 6 is fixed to the case. In the embodiment of the present invention, the voice coil 16 may be secured to the vibrating plate 17 after the vibrating plate is fixed to the upper case 12*a*. Therefore, the assembling operation can be easily performed since the vibrating plate 17 is enforced by the upper case 12*a*. Furthermore, since the vibrating plate 17 is secured to the upper case 12*a*, the positioning of the voice coil 16 can be easily carried out.

Since the vibrating plate 17 is enforced by the upper case 12*a* as described above, the securing operation of the voice coil 16 can be performed by automatic operation.

Thus assembled upper case 12*a* is adhered to the lower case 12*b*, and the ends 20 are bent as shown in FIG. 1. Since the end 20 is engaged in the groove 23, the end is not compressed by the upper case 12*a*.

In accordance with the present invention, the case is divided into the upper case and the lower case, and the vibrating plate is secured to the upper case. Therefore, the vibrating plate is enforced by the upper case, so that the voice coil can be easily fixed to the vibrating plate.

While the invention has been described in conjunction with preferred specific embodiment thereof, it will be understood that this description is intended to illustrate and not limit the scope of the invention, which is defined by the following claims.

What is claimed is:

1. A microspeaker comprising:

a case comprising an assembled upper case and an assembled lower case;

the assembled lower case having a lower case portion, a yoke made of a magnetic material and secured to the lower case portion, a permanent magnet secured to the yoke, and a pair of terminal plates secured to the underside of the lower case portion;

the assembled upper case having an upper case portion with an annular peripheral wall, a vibrating plate secured to the upper case portion, a voice coil secured to an underside of the vibrating plate, and a protector plate secured to the peripheral wall; and means for securing the assembled upper case to the assembled lower case;

the voice coil having a pair of ends outwardly extended from the coil, each of the ends being secured to an underside of the vibrating plate, passed through a groove formed in the peripheral wall of the upper case, and through a peripheral wall of the lower case, and connected to one said terminal plate.

2. The microspeaker according to claim 1, wherein the means for assembling comprises adhesive.

* * * * *